US009143871B2

(12) United States Patent
Van Doorn

(10) Patent No.: US 9,143,871 B2
(45) Date of Patent: Sep. 22, 2015

(54) MICRO CONVERTER, AUDIO DEVICE AND HEARING AID

(75) Inventor: Jan Marinus Van Doorn, Alkmaar (NL)

(73) Assignee: EXSILENT RESEARCH B.V., Amsterdam (NL)

( * ) Notice: Subject to any disclaimer, the term of this patent is extended or adjusted under 35 U.S.C. 154(b) by 11 days.

(21) Appl. No.: 14/003,011

(22) PCT Filed: Mar. 1, 2012

(86) PCT No.: PCT/NL2012/050124

§ 371 (c)(1),
(2), (4) Date: Oct. 2, 2013

(87) PCT Pub. No.: WO2012/121591

PCT Pub. Date: Sep. 13, 2012

(65) Prior Publication Data

US 2014/0016809 A1 Jan. 16, 2014

(30) Foreign Application Priority Data

Mar. 4, 2011 (NL) ..... 2006343

(51) Int. Cl.

| | |
|---|---|
| ***H04R 1/00*** | (2006.01) |
| ***H04R 25/00*** | (2006.01) |
| ***H04R 9/02*** | (2006.01) |
| *H04R 1/10* | (2006.01) |
| *H04R 9/04* | (2006.01) |
| *H04R 25/02* | (2006.01) |

(52) U.S. Cl.

CPC ..... *H04R 25/00* (2013.01); *H04R 9/025* (2013.01); *H04R 1/1016* (2013.01); *H04R 9/041* (2013.01); *H04R 25/02* (2013.01)

(58) Field of Classification Search

USPC ..... 381/412, 421

See application file for complete search history.

(56) References Cited

U.S. PATENT DOCUMENTS

| | | | | |
|---|---|---|---|---|
| 5,835,612 | A * | 11/1998 | Fujihira et al. | 381/421 |
| 5,923,769 | A * | 7/1999 | Fushimi | 381/338 |
| 2003/0123692 | A1 | 7/2003 | Ueki | |
| 2004/0086149 | A1 | 5/2004 | Johannsen et al. | |
| 2004/0151334 | A1 | 8/2004 | Vaudrey et al. | |
| 2007/0140522 | A1 * | 6/2007 | Stewart | 381/421 |
| 2008/0044044 | A1 | 2/2008 | Madaffari et al. | |
| 2011/0249833 | A1 * | 10/2011 | Shin | 381/151 |
| 2012/0070024 | A1 * | 3/2012 | Anderson | 381/328 |

FOREIGN PATENT DOCUMENTS

WO 2007/010458 A2 1/2007

OTHER PUBLICATIONS

International Search Report, dated Apr. 26, 2012, from corresponding PCT application.

* cited by examiner

*Primary Examiner* — Davetta W Goins
*Assistant Examiner* — Amir Etesam
(74) *Attorney, Agent, or Firm* — Young & Thompson

(57) ABSTRACT

An electro-acoustic micro-converter can be applied in an audio device, and in particular in a hearing aid. The micro-converter is at least substantially block-shaped and includes an at least substantially rectangular acoustic membrane tensioned therein transversely of a longitudinal direction. A coil element is carried by the membrane and extends in a magnetic field maintained by magnet elements, including a permanently magnetic magnet body, in a coil gap around the magnet body.

20 Claims, 3 Drawing Sheets

MICRO CONVERTER, AUDIO DEVICE AND HEARING AID

BACKGROUND OF THE INVENTION

1. Field of the Invention

The present invention relates to an electro-acoustic micro-converter for generating sound from an electronic input signal, in particular for a device worn in an ear of a user, comprising a device housing with a sound output in which a membrane assembly is suspended with freedom of movement, the membrane assembly comprising an acoustic membrane and a coil element connected thereto, wherein the coil element is provided with connecting means for receiving the electronic input signal and extends in a coil gap, and wherein the device housing comprises magnet means which maintain a magnetic field in the coil gap, the magnet means comprising a permanently magnetic magnet body.

Such a converter is also referred to as a transceiver or receiver and is normally applied for the purpose of acoustic reproduction of sound on the basis of an electronic audio signal. As such, electro-acoustic converters find their way into electronic devices of diverse nature, such as for instance (mobile) phones, computers and, by no means least, hearing aids and other audio devices worn in the ear and having a device housing which is worn wholly or largely concealed in the ear, such as earphones and active audio filters.

A great challenge in the case of this latter group is the far-reaching miniaturization of the components received therein because of the limited placing space in an auditory canal of a user. This miniaturization also applies for the electro-acoustic converter applied therein, which in this case is therefore normally referred to as miniature or micro-converter. An extreme degree of miniaturization of an electro-acoustic converter does however quickly result in a limitation of the surface area available for the active membrane, and thereby in a reduction in the maximum acoustic output power that can be produced. Miniaturization moreover involves the danger of an audible deterioration in the sound quality.

Micro-converters of the so-called balanced armature type are usually applied for hearing aids. Such a micro-converter is based on magnetic forces exerted between a pair of magnetic poles of permanent magnet bodies located opposite each other on a magnetically susceptible armature element. The armature element is suspended here for movement between a pair of coil elements to which an electronic audio signal is supplied. A rapidly changing electronic audio input signal is sent through the coils, whereby the armature element suspended therebetween is set into vibration and transmits its movement to an acoustic membrane connected to the armature element. The membrane thus set into vibration in turn produces sound which is representative of the supplied audio signal and which can exit from the sound output.

A relatively high efficiency can be achieved with such a device by selecting an eigenfrequency of the armature assembly in an efficient acoustic frequency range. This relatively high efficiency does not however apply at all outside this range, whereby such converter is intended mainly for a high acoustic output power in a relatively narrow frequency range. For more wideband applications, such as for pure audio reproduction, i.e. over a relatively wide frequency spectrum, such a balanced armature converter is therefore a less likely solution. A balanced armature converter is moreover relatively expensive due to the relatively large number of components applied therein and the manufacturing steps required therefore. Particularly the exact placing and alignment of the armature element precisely in the centre of the air gap between the two magnetic poles, in addition to the magnetic balance required between these two latter, require high precision and result in an increase in the cost price.

A more natural and therefore clearer audio reproduction can be achieved with a converter of the type stated in the preamble, which is also referred to as the so-called moving coil type. Converters of this type are therefore not infrequently applied in loudspeakers of hi-fi systems, in headphones and earphones and in mobile electronic products such as telephones and computers. A characteristic of this type of converter is that the acoustic membrane is coupled to an electronic coil element which is suspended with freedom of movement in a permanent magnetic field maintained by a permanent magnet body. This type of converter is generally less well suited for miniature applications, such as in a device worn in the ear, because of the generally inadequate conversion efficiency. The converter therefore requires relatively large dimensions which are not consistent with a miniature application, such as in the ear, and moreover consumes a relatively large amount of power, which is likewise disadvantageous for a miniature application such as in the ear, which normally is wholly dependent for its electrical power supply on the relatively modest capacity of a battery or accumulator.

2. Description of the Related Art

An example of a miniature electroacoustic moving coil converter is described in the American patent application USP 2008/0044044. This known micro-converter comprises a device housing having therein a permanent magnetic body provided with pole bodies which together maintain a permanent magnetic field through a coil element extending from an acoustic membrane suspended in freely movable manner. For the purpose of increasing the acoustic output power, this known converter here comprises not one but two acoustic membranes, each with such a coil element in the magnetic field of the magnet means. A drawback hereof is however an increased complexity of the device as a whole and the necessity of a sound channel in which the sound waves of both membranes are brought together acoustically and carried to a shared sound output. The device hereby becomes more voluminous. For application deep in an auditory canal of a user, such as in the case of a device worn in the ear and in particular a completely-in-canal (CIC) hearing aid, the known construction is therefore far from optimal.

BRIEF SUMMARY OF THE INVENTION

The present invention has for its object, among others, to provide a micro-converter of the type stated in the preamble which is relatively compact but nevertheless able to produce a sufficiently large acoustic sound pressure with a sound quality which is exceptionally natural for such a compact device and with an unprecedented conversion efficiency.

In order to at least largely achieve the stated object, an electro-acoustic converter of the type described in the preamble has the feature according to the invention that the magnet body is located within an at least substantially rectangular first contour around which the coil gap with the coil element therein extends while at least substantially following the contour, that the device housing comprises adjacently of the coil gap at least one magnetically conductive wall part extending along an at least substantially rectangular second contour which surrounds the first contour, and that the membrane extends over the whole magnet body at least substantially parallel to a main plane formed by the first contour, and on a side remote from the magnet body is in open communication with a hollow sound chamber which is bounded by magnetically non-conductive chamber walls and of which a chamber wall oriented substantially transversely of the membrane is provided with the sound output. The invention thus provides for optimal utilization of space available for the components to be accommodated such that, despite a very small frontal cross-section of the device housing, a sufficient output level can nevertheless be achieved with an unequalled sound quality for such a small device. This is the result on the one hand of the central location of the magnet body within the elongate, in particular rectangular first contour which thus has a relatively large area available. On the other hand the frontal cross-section nevertheless remains limited in that the first contour of the magnet body and the membrane are oriented in a direction transversely thereof and can therefore be given a larger form while frontal dimensions remain the same.

The magnet body of the device according to the invention can thus be relatively large and therefore relatively powerful. An optimal magnetic field strength, or flux density, in the coil gap is achieved here in that the magnetically conductive wall part, which is at least partly responsible for return of magnetic field lines, likewise follows an elongate, in particular rectangular contour. The invention is based here on the insight that, compared to a round contour normally applied in converters of the stated type, an elongate, and in particular rectangular contour, moreover provides at the same wall thickness a considerably larger available area in the wall cross-section through which magnetic field lines can be returned. This results in a lower magnetic resistance and thereby in a more efficient utilization of the magnetic field of the magnet body.

The magnetically inert walls of the sound chamber moreover ensure here that as little as possible of the magnetic field will leak away in the direction thereof. The invention thus provides within the available volume of the device housing an exceptionally large magnetic flux in the coil gap, this becoming manifest in the final output efficiency. The device combines this output efficiency with a sound quality unequalled for such a compact converter.

In a particular embodiment the micro-converter according to the invention has the feature that the at least one wall part parallel to the main plane comprises an overall magnetically conductive surface area of at least about 5 square millimeters. It has been found that such a minimal conductive section of the at least one wall part in a compact device provides a sufficiently low magnetic resistance to enable a magnetic flux in the order of a minimum of 0.8 Tesla to be realized in the coil gap. This is sufficient for the conversion efficiency intended with the device.

A preferred embodiment of the micro-converter according to the invention has the feature that the second contour defines a contour of the device housing and that the membrane is tensioned over at least substantially a whole surface thereof. The at least one wall part thus forms not only the flux return path for the magnetic field in the coil gap, but also an outer wall of the device housing. The wall part can optionally be provided here, in particular externally, with a protective coating and/or a biocompatible covering. Parallel to the main plane the device housing is thus not (much) larger than the second contour, and therefore remains relatively compact. With a view to a sufficient mechanical strength and handling of the device housing, a further particular embodiment of the converter has the feature here according to the invention that the at least one wall part has a wall thickness of at least about 170 micron. Excellent results can be achieved in this respect with a further particular embodiment of the converter according to the invention characterized in that the at least one wall part comprises a ferro-metal, and is manufactured particularly from a material from a group comprising iron, nickel, nickel-iron, silicon-iron and cobalt-iron. These materials all combine a sufficient mechanical strength with an adequate magnetic conductivity, and are therefore highly suitable within the context of the invention for providing an outer wall (part) of the device housing as well as a flux return path for the magnet means.

The magnet means of the converter according to the invention comprise at least one permanently magnetic magnet body, in a particular embodiment a ferromagnetic magnet body of a highly energetic ferromagnetic alloy, more particularly of aluminium-nickel-cobalt or neodymium-iron-boron. In order to guide the permanent magnetic field emanating therefrom and concentrate it on the coil gap, a further particular embodiment of the converter according to the invention has the feature that the magnet means comprise within the first contour a first magnetically inducible pole body which is in contact with the magnet body, and that the first pole body is surrounded in a spatially separated relation by at least one further magnetically inducible pole body while enclosing the coil gap. With a suitable positioning of the pole bodies a considerable increase in the magnetic flux in the coil gap can thus be achieved, this in turn manifesting itself in a higher conversion efficiency of the converter as a whole.

A further particular embodiment of the converter according to the invention has in this respect the feature that at least one further pole body extends from the at least one wall part. The further pole body thus provides for a focusing of the magnetic field in the coil gap and for guiding thereof in the flux return path provided by the wall part to an opposite magnetic pole of the magnet body. Particularly good results can be achieved in this respect with a further particular embodiment of the converter according to the invention which is characterized in that at least one further pole body extends parallel to the main surface over an area of at least about 5 square millimeters inside the coil gap. Although various magnetically inducible materials are suitable for the pole bodies, a preferred embodiment of the converter according to the invention has the feature that the pole bodies comprise a ferro-metal, in particular iron, nickel or iron/nickel in at least substantially equal quantities.

In a further particular embodiment the converter according to the invention has the feature that the coil body comprises flat windings wound from wire of at least one metal from a group comprising copper, aluminium, silver and gold. The windings preferably lie here round the first contour in the coil gap while following the contour as closely as possible, and are stacked on each other in order to obtain a large overall wire length. The force which can be exerted in the magnetic field on the membrane by the coil element under the influence of the input signal is directly proportional to the overall wire length, and will thus increase linearly due to stacking of windings. Owing to their excellent electrical conductivity, the stated metals allow the use of a thin wire here so that, even within a very compact environment such as that of a micro-converter, a high overall wire length can nevertheless be obtained. Practical values are realized in this respect with a particular embodiment of the converter according to the invention which is characterized in that the coil body comprises flat windings with an overall length of at least about 3 meters, and that the magnet means maintain a magnetic field with a magnetic flux density B through the coil element in the order of 0.8 Tesla.

With a view to applications deep in an auditory canal of a user, such as a completely-in-canal (CIC) device, very small dimensions of the device housing are of great importance because the dimensions of the device as a whole can remain more limited, which also contributes toward wearer comfort. Owing to an excellent conversion efficiency, the converter according to the invention allows such miniature dimensions without detracting from sufficient acoustic output power. The converter according to the invention moreover achieves this with a sound quality and clarity which are surprising for a miniature device. A particular embodiment of the converter according to the invention specifically suited for such CIC and other applications has in this respect the feature that the device housing is flat with a length of at least about 4.5 millimeters which is bounded by opposite at least substantially rectangular front walls with a diagonal dimension of less than 4.5 millimeters, more particularly that the device housing is at least substantially block-shaped with a length in the order of about 5 millimeters and a width of about 3.5 millimeters, wherein the wall part has a height in the order of about 1.8 millimeters.

In order to disrupt as little as possible and maintain the magnetic field in the coil gap a further particular embodiment of the converter according to the invention has the feature that the sound chamber is enclosed by walls of a magnetically inert material, in particular a material from a group of stainless steel, copper, brass and plastics. The magnetically inert walls of the sound chamber thus leave the magnetic field lines of the magnetic field in the coil gap intact so that they are optimally concentrated on the coil element instead of partially leaking away to the sound chamber.

In order to enhance reproduction of low tones a preferred embodiment of the converter according to the invention has the feature that the housing comprises on a side remote from the sound chamber a further hollow chamber which is closed to the outside and which is in open communication with the membrane via at least one sound channel. An extra volume inside the device housing which can be addressed for the reproduction of low-frequency tones is thus in open communication with the membrane in order to generate sufficient sound pressure. Use is preferably also made for chamber walls of this bass chamber, just as for the output sound chamber, of a magnetically inert material, such as particularly stainless steel, copper, brass or a plastic.

The invention also relates to an audio device comprising a device which is worn in the ear and which is adapted and intended to be worn at least substantially wholly concealed in an auditory canal of a user, wherein the device worn in the ear comprises a micro-converter according to the invention, and to a hearing aid comprising such an audio device.

BRIEF DESCRIPTION OF THE DRAWINGS

The invention will now be further elucidated on the basis of an exemplary embodiment and an accompanying drawing. In the drawing.

DETAILED DESCRIPTION OF THE PREFERRED EMBODIMENTS

Figure 1:
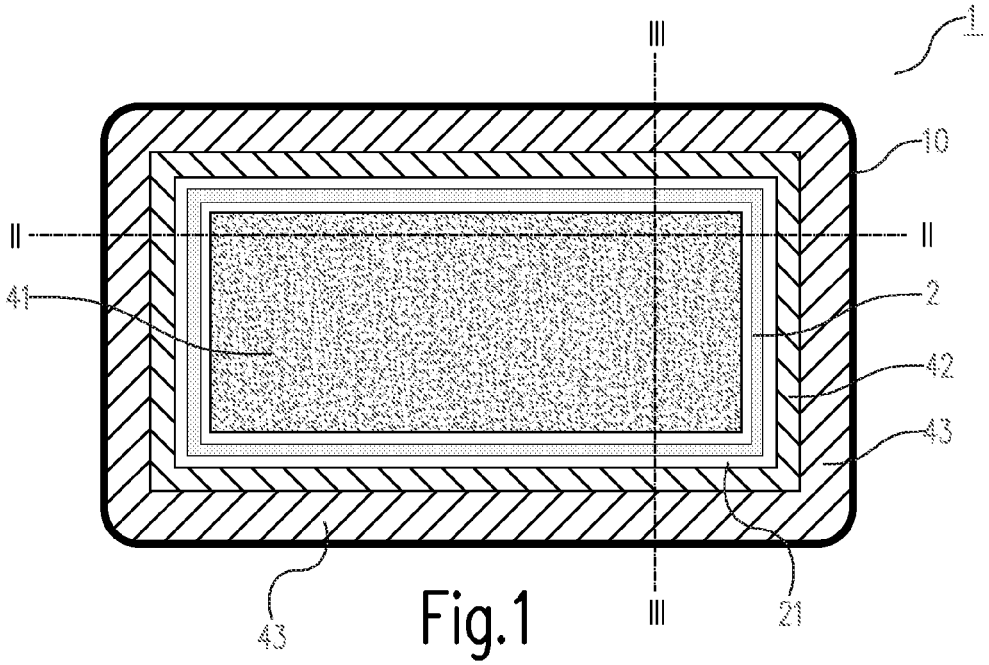
FIG. 1 shows a longitudinal section of an exemplary embodiment of a micro-converter according to the invention.

The figures are otherwise purely schematic and not always drawn to scale. Some dimensions in particular are exaggerated to greater or lesser extent for the sake of clarity.

Corresponding parts are designated generally in the figures with the same reference numeral.

FIG. 1 shows an exemplary embodiment of a micro-converter according to the invention which, owing to its very small outer dimensions, is highly suitable for application in an audio device worn wholly in the ear, such as particularly a part of a hearing aid worn wholly in the ear or a completely-in-canal (CIC) hearing aid. The converter is accommodated in a device housing 1. Device housing 1 comprises a pair of wall parts 43 of a metal with good magnetic conductivity, a bottom 12 and a cover 13 of a magnetically inert material for an increased efficiency, as will be further elucidated below. A biocompatible plastic or stainless steel is applied in this case for bottom 12 and cover 13. Device housing 1 can optionally be provided externally with a biocompatible coating or casing 10, for instance of a polyurethane.

Contact surfaces 121, so-called solder pads or bumps, are arranged close thereto (only one contact surface 121 is shown in the figures). Contact surfaces can optionally be connected to a printed circuit board (not shown), for instance a printed circuit board comprising a glass fibre-reinforced epoxy laminate, also referred to as FR4. This material has an excellent strength-weight ratio. Provided inside wall parts 43 are a pair of pole bodies (pole shoes), and thereby a magnetic flux path with a relatively low resistance and small losses, as will be further discussed below.

Figure 2:
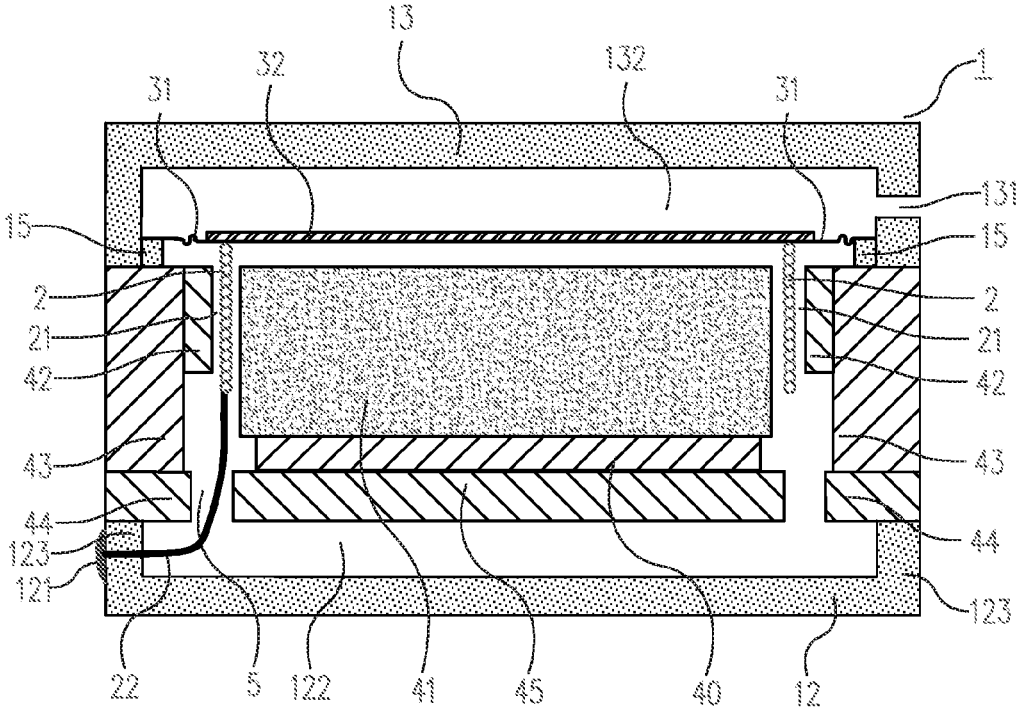
FIG. 2 shows a cross-section of the device of FIG. 1 along the line
Figure 4:
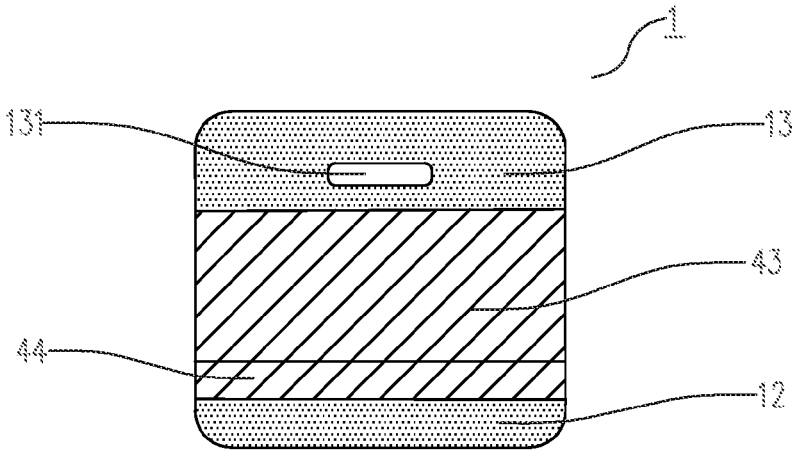
FIG. 4 shows a front view of the device of FIG. 1.

Contact surfaces 121 on an outer side close to bottom 12 provide an external electronic connection option. As such the contact surfaces 121 allow a flush electronic mounting (SMD) of the converter on conductor tracks on a further printed circuit board or a printed circuit foil. Contact surfaces 121 are connected internally by means of connecting wire 22 to respectively an input and an output of a coil element 2 suspended freely in device housing 1, see also FIG. 2. Cover 13 of device housing 1 is provided on a front side, see also FIG. 4, with a sound output 131 in open communication with a surrounding area. Sound generated by the converter will exit to the surrounding area substantially via the sound output 131.

Device housing 1 imparts strength to the device and protects the device from external influences. Instead of being accommodated in such a stand-alone device housing, the device can also be accommodated and integrated directly in for instance an earphone or other larger whole. This larger whole functions in that case as device housing. Device housing 1 provides space for the acoustic and electronic components of the converter as well as to a closed magnetic circuit. The acoustic part is formed by an acoustic membrane 31, 32 which is suspended with freedom of movement in a longitudinal direction of device housing 1. Membrane 31, 32, in this exemplary embodiment an aluminium membrane, is held for this purpose in a form-retaining, relatively stiff diaphragm ring 15 and adhered therein as acoustic seal via a flexible plastic carrier 31, in this example a polyester film with a thickness of about 6 micron. The seal serves as acoustic separation between the volumes 132 and 21 on either side of the membrane. The shown wave form in the plastic film applied for this purpose provides for freedom of movement and must therefore be relatively limp so that a small force on membrane 31, 32 will already bring about a relatively large movement thereof.

Diaphragm ring 15 is in turn adhered inside a peripheral edge in device housing 1. The actual membrane 31, 32 comprises a flexible plastic carrier 31, for instance of polyester film, to which a stiff sheet 32 of plastic or of a metal, such as aluminium or an aluminium alloy, is adhered or fused. Membrane 31, 32 is in open communication on an external side with an acoustic output chamber 132 formed at that position by cover 13. The above mentioned electronic coil element 2 is connected mechanically to membrane 31, 32 and extends in a narrow coil gap 21 between opposite pole bodies 41, 42 or pole shoes of the magnetic circuit in the converter.

The magnetic circuit is formed and maintained by magnet means which are received in device housing 1 and the core of which is formed by a permanently magnetic magnet body 40. Instead of a single magnet body 40, more of such magnet bodies 40 can otherwise also be applied. The stronger the magnetic field generated thereby, the stronger will be the Lorentz forces to which the coil element 2 will be subjected during operation, and thereby the sound pressure which the converter can produce. With a view hereto a highly energetic ferromagnetic alloy is applied for magnet body 40, such as Aluminium-Nickel-Cobalt (AlNiCo), Samarium-Cobalt (SmCo) or Neodymium-Iron-Boron ($Nd_2Fe_{14}B$).

Magnet body 40 has parallel to membrane 31, 32 an elongate, at least substantially rectangular contour with a length and width of about 3.6 by 1.4 millimeter (±0.1 millimeter) and is about 0.25 millimeter (±0.1 millimeter) thick. Despite these relatively modest dimensions, magnet body 40 is able, as a result of the material applied therefore, to produce a relatively strong magnetic field, this being manifested in a magnetic flux density (B) in coil gap 21 in the order of 0.8 Tesla. Also contributing toward this are several magnetic pole bodies 41 . . . 45 of a magnetically soft inducible material, which serve to concentrate the magnetic field lines in and return them to the coil gap. Because of their magnetic properties many materials containing iron, cobalt or nickel are highly suitable for the pole bodies 42, such as, in addition to these metals in pure form, alloys thereof optionally supplemented with mineral additives such as silicon.

Coil element 2 comprises a coil winding of silver, aluminium or copper wire. In the device of the present embodiment this coil winding has in the order of 300 windings stacked in six layers with an overall length (l) in the order of 3 meters, and a thickness of outer wall 43 amounts to about 350 micron. A value of B·l of 2.4 Tm is thus obtained. $F=B\cdot l\cdot I=2.4\cdot I$ N therefore applies for the Lorentz force to which coil element 2 is subjected during operation, wherein I is the momentary electric current through coil element 2. This is exceptionally high for a converter of the stated small dimensions. The overall electrical resistance of coil element 2 amounts all in all to the order of about 170 ohm. Coil element 2 extends here beyond pole body 42 so that coil element 2 is present to the greatest possible extent in the magnetic field. This contributes toward a magnetic linearity of coil element 2 and an energy efficiency thereof.

Figure 3:
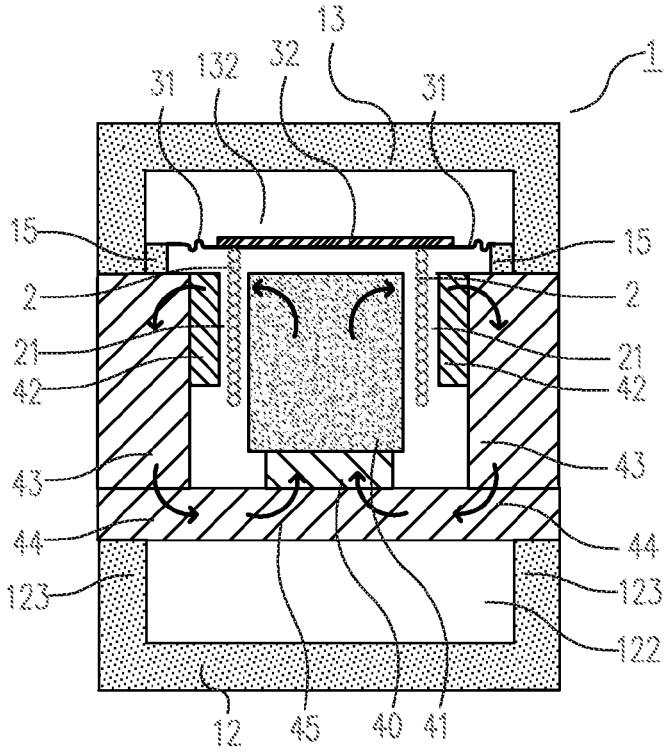
FIG. 3 shows a cross-section of the device of FIG. 1 along the line

The invention is further based on the insight that it is not only the strength of the magnetic field but also the maximum flux density in the flux return path from the magnetic north pole to the magnetic south pole which determines the final acoustic output of the converter. This flux return path extends substantially in the hatched parts in FIG. 3 and is indicated schematically therein by means of a number of arrows. For this reason side walls 43 of device housing 1 are manufactured at least over a part of their wall thickness from a magnetically highly conductive metal, such as a 50%-50% nickel-iron, pure iron, iron-silicon or cobalt-iron, in order to thus make a significant contribution to the total available flux return path. Device housing 1 moreover takes an elongate, in particular rectangular form. The invention is based here on the insight that a magnetic saturation is associated with an available magnetically conductive cross-sectional area transversely of the flux return path, as provided in this embodiment by inter alia the side walls 43 of device housing 1, and that an elongate, at least substantially rectangular contour of these side walls to very small dimensions enhances a low magnetic resistance. Calculations show that with the said dimensions and a wall thickness of about 0.35 millimeter (±0.1 millimeter) the side walls 43 of device housing 1 of the converter described here are not saturated magnetically any sooner than at a magnetic flux density in the order of 1.5-2.1 Tesla.

A determining factor here is that, the smaller an outer periphery of device housing 1 is made, as is essential with extreme miniaturization, an internally available space will thereby also decrease while maintaining wall strength. In the case of a device housing with a round contour normally applied for a micro-converter the internal diameter will decrease even more rapidly than the outer diameter while maintaining wall strength, whereby in the case of further miniaturization a cylindrical device housing will quickly be unable to provide sufficient internal space to accommodate all components of the micro-converter therein. With a view hereto, a device housing 1 is applied according to the invention with an elongate, and more particularly rectangular outer contour at least parallel to membrane 31, 32. The device housing 1 in the shown embodiment has as such a rectangular contour with a length lying typically between 5.0 and 5.5 millimeters (±0.2 millimeter) and a width in the order of 3.5 millimeters. The central part of the converter has a height of no more than about 1.8 millimeters. With the cover and the bottom added, the overall height of the device housing amounts to less than 3.0 millimeters. A maximum front dimension, in this case a diagonal length of a front side, thus amounts to less than about 4.5 millimeters, whereby the converter is sufficiently limited in frontal size that it can be wholly received in an auditory canal of a user.

Transversely of this direction the auditory canal provides more space to be able to receive the longer length of the device housing. The increase in this dimension manifests itself in a proportionally large membrane surface area and likewise available area for the central magnet body 40, whereby the device is able to produce a relatively large output power, and thereby a relatively high conversion efficiency. For the purpose of an improved reproduction of low tones the device housing 1 comprises on the bottom side a further sound chamber 122 to which the membrane 31, 32 is connected acoustically via a pair of acoustic channels 5 (the figure shows one channel 5, the other available channel being situated outside the plane of the drawing). The thereby provided increased air volume can thus be utilized acoustically for an improved bass reproduction. These same channels 5 moreover provide a passage for a pair of connecting wires between coil element 2 and contact surfaces 121 close to the outer side of bottom 12. Damping materials or constructions can optionally be provided in channels 5 in order to further implement a frequency response of the device. The bottom volume is bounded by magnetically non-conductive walls 123 of plastic or stainless steel, so that no magnetic field is extracted hereby from the magnetic circuit in the converter.

Thus realized according to the invention is a substantially blocked-shaped micro-converter with a membrane 31, 32 tensioned in the longitudinal direction and extending over substantially the whole longitudinal surface so as to thus obtain a high output power, while the transverse dimensions remain limited and can in particular be smaller than an anatomical inner diameter of an auditory canal of a user. The converter is characterized by its exceptionally small minimal dimensions, a particularly low harmonic deformation and a natural, clear audio reproduction which, if desired, can be enjoyed over an exceptionally wide frequency range.

Figure 5A:
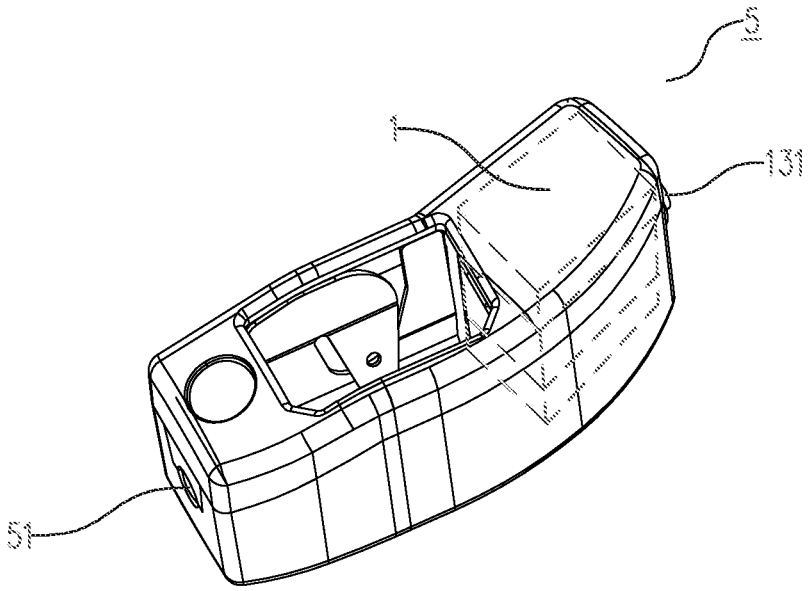
FIG. 5*a* shows an exemplary embodiment of an audio device provided with the device of FIG. 1.
Figure 5B:
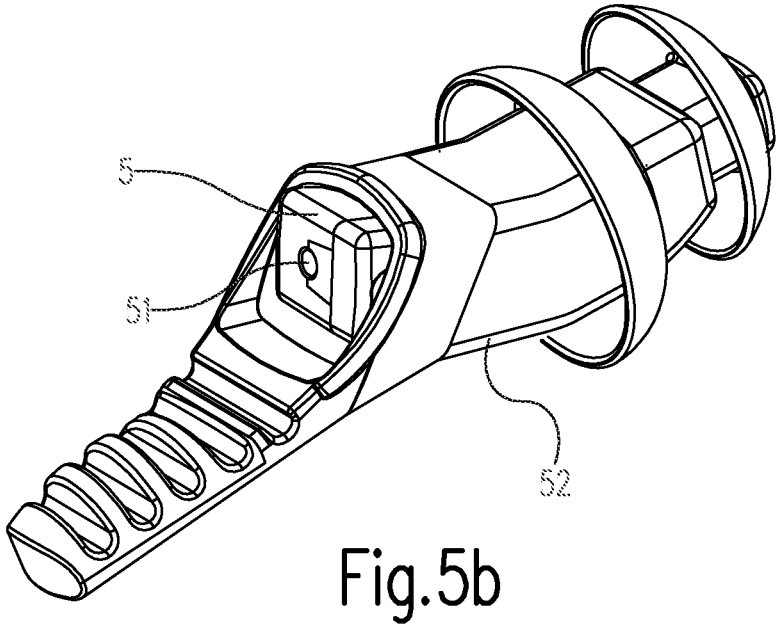
FIG. 5*b* shows an exemplary embodiment of an audio device provided with the device of FIG. 1 in a casing.

The micro-converter is therefore highly suitable for application in an audio device worn wholly in the ear such as the CIC hearing aid shown in FIG. 5*a*. Micro-converter 1 is accommodated here in a form-retaining central module 5 which moreover provide space for inter alia a battery, a microphone 51 and a sound processing unit (DSP). Sound output 131 is located on the side opposite the side where microphone 51 is situated. FIG. 5*b* shows module 5 encased in a relatively soft flexible casing 52, also referred to as a soft tip, for a comfortable and correct fit in the auditory canal.

Although the invention has been further elucidated solely on the basis of a single exemplary embodiment, it will be apparent that the invention is by no means limited thereto. On the contrary, many variations and embodiments are possible within the scope of the invention for the person with ordinary skill in the art. In addition to being provided on a front side, the sound output can for instance also be provided on a longitudinal side of the cover, therefore transversely of a direction of movement of the membrane.

In the shown exemplary embodiment the further sound chamber 122 can for instance also be omitted. Although this will result in a lesser reproduction of low tones, a more compact device is thus obtained.

The invention claimed is:

1. An electro-acoustic micro-converter for generating sound from an electronic input signal, in particular for a device worn in an ear of a user, comprising a device housing with a sound output in which a membrane assembly is suspended with freedom of movement, the membrane assembly comprising an acoustic membrane and a coil element connected thereto, wherein the coil element is provided with connecting means for receiving the electronic input signal and extends in a coil gap, and wherein the device housing comprises magnet means which maintain a magnetic field in the coil gap, the magnet means comprising a permanently magnetic magnet body, wherein the magnet body is located within an at least substantially rectangular first contour around which the coil gap with the coil element therein extends while at least substantially following the contour, the device housing comprises adjacently of the coil gap at least one magnetically conductive wall part extending along an at least substantially rectangular second contour which surrounds the first contour, and the membrane extends over the whole magnet body at least substantially parallel to a main plane formed by the first contour, and on a side remote from the magnet body is in open communication with a hollow sound chamber which is bounded by magnetically non-conductive chamber walls and of which a chamber wall oriented substantially transversely of the membrane is provided with the sound output.

2. The micro-converter as claimed in claim 1, wherein the at least one wall part parallel to the main plane comprises an overall magnetically conductive surface area of at least about 5 square millimeters.

3. The micro-converter as claimed in claim 1, wherein the second contour defines a contour of the device housing and the membrane is tensioned over at least substantially a whole surface thereof.

4. The micro-converter as claimed in claim 3, wherein the at least one wall part has a wall thickness of at least about 170 micron.

5. The micro-converter as claimed in claim 1, wherein the at least one wall part comprises a ferro-metal.

6. The micro-converter as claimed in claim 1, wherein the magnet means comprise within the first contour a first magnetically inducible pole body which is in contact with the magnet body, and the first pole body is surrounded in a spatially separated relation by at least one further magnetically inducible pole body while enclosing the coil gap.

7. The micro-converter as claimed in claim 1, wherein the at least one further pole body extends from the at least one wall part.

8. The micro-converter as claimed in claim 6, wherein the at least one further pole body extends parallel to the main surface over an area of at least about 5 square millimeters inside the coil gap.

9. The micro-converter as claimed in claim 6, wherein the pole bodies comprise a ferro-metal.

10. The micro-converter as claimed in claim 1, wherein the magnet body comprises a highly energetic ferromagnetic alloy.

11. The micro-converter as claimed in claim 1, wherein the coil body comprises flat windings wound from wire of at least one metal from a group comprising copper, aluminium, silver and gold.

12. The micro-converter as claimed in claim 1, wherein the coil body comprises flat windings with an overall length of at least about 3 meters, and the magnet means maintain a magnetic field with a magnetic flux density B through the coil element in the order of 0.8 Tesla.

13. The micro-converter as claimed in claim 1, wherein the device housing is flat with a length of at least about 4.5 millimeters which is bounded by opposite at least substantially rectangular front walls with a diagonal dimension of less than 4.5 millimeters, more particularly the device housing is at least substantially block-shaped with a length in the order of about 5 millimeters and a width of about 3.5 millimeters, wherein the wall part has a height in the order of about 1.8 millimeters.

14. The micro-converter as claimed in claim 1, wherein the sound chamber is enclosed by walls of a magnetically inert material, in particular a material from a group of stainless steel, copper, brass and plastics.

15. The micro-converter as claimed in claim 1, wherein the housing comprises on a side remote from the sound chamber a further hollow chamber which is closed to the outside and which is in open communication with the membrane via at least one sound channel.

16. An audio device comprising a device which is worn in the ear and which is adapted and intended to be worn at least substantially wholly concealed in an auditory canal of a user, wherein the device worn in the ear comprises a micro-converter as claimed in claim 1.

17. A hearing aid comprising an audio device as claimed in claim 16.

18. The micro-converter as claimed in claim 1, wherein the at least one wall part comprises a ferro-metal, and is manufactured from a material from a group comprising iron, nickel, nickel-iron, silicon-iron and cobalt-iron.

19. The micro-converter as claimed in claim 6, characterized in that wherein the pole bodies comprise a ferro-metal selected from the group consisting of iron, nickel, and iron/nickel in at least substantially equal quantities.

20. The micro-converter as claimed in claim 1, wherein the magnet body comprises aluminum-nickel-cobalt, samarium-cobalt or neodymium-iron-boron.

* * * * *